US008348815B2

(12) United States Patent
Signorino

(10) Patent No.: US 8,348,815 B2
(45) Date of Patent: Jan. 8, 2013

(54) INTERACTIVE BOXING TRAINING DEVICE

(76) Inventor: John Signorino, Cedar Park, TX (US)

( * ) Notice: Subject to any disclaimer, the term of this patent is extended or adjusted under 35 U.S.C. 154(b) by 353 days.

(21) Appl. No.: 12/880,596

(22) Filed: Sep. 13, 2010

(65) Prior Publication Data

US 2011/0071007 A1 Mar. 24, 2011

Related U.S. Application Data

(60) Provisional application No. 61/277,129, filed on Sep. 21, 2009.

(51) Int. Cl.
*A63B 70/00* (2006.01)

(52) U.S. Cl. ..... 482/83; 482/4; 482/84

(58) Field of Classification Search ..... 482/81–90, 482/1–9, 148; 463/47.4
See application file for complete search history.

(56) References Cited

U.S. PATENT DOCUMENTS 2,634,535 A * 4/1953 Borders ..... 42/1.08
3,728,809 A * 4/1973 Mulich et al. ..... 42/13
3,804,406 A * 4/1974 Viscione ..... 482/4
4,401,303 A * 8/1983 Anderson et al. ..... 482/4
4,765,609 A * 8/1988 Wilson et al. ..... 482/83
4,819,137 A * 4/1989 Hamilton ..... 362/102
5,052,683 A 10/1991 Wang et al.
5,053,683 A * 10/1991 Theroux ..... 315/290
5,100,138 A * 3/1992 Wilde ..... 273/440.1
5,230,324 A * 7/1993 Van Horssen et al. ..... 124/61
5,665,035 A * 9/1997 Tumminia ..... 482/83
5,700,230 A * 12/1997 Cardona ..... 482/83
5,735,775 A * 4/1998 Miasserian ..... 482/83
6,416,445 B1 * 7/2002 Nelson et al. ..... 482/83
7,316,621 B2 * 1/2008 Tufts ..... 463/47.4
7,857,729 B2 * 12/2010 Sullivan et al. ..... 482/4
7,922,628 B2 * 4/2011 Gonzalez ..... 482/90
8,079,938 B2 * 12/2011 Jones et al. ..... 482/8
2004/0248633 A1 12/2004 Trawick et al.

* cited by examiner

*Primary Examiner* — Stephen Crow
(74) *Attorney, Agent, or Firm* — Charles D. Gunter, Jr.

(57) ABSTRACT

An interactive boxing training device is made up of an inner tube, an outer tube and a fluid propulsion system for propelling the outer tube outwardly along a generally horizontal axis in a stroke defined between a retracted position and an extended position, upon demand. A retraction system returns the outer tube to the retracted position after each stroke. The inner tube is mounted in a housing at a pivot point which allows 360 degrees of freedom of movement. The housing is itself mounted on an upright rail which allows the housing to have a vertically adjustable height. The retraction system is made up of one or more elastomeric elements which are stretched as the outer tube moves to the extended position and which are relaxed as the outer tube moves back to the retracted position. The housing is also removable from the upright rail so that the device can be pointed at a boxing trainee in order to simulate punches thrown at the boxing trainee.

15 Claims, 3 Drawing Sheets

INTERACTIVE BOXING TRAINING DEVICE

CROSS REFERENCE TO RELATED APPLICATIONS

The present application claims priority from a provisional application Ser. No. 61/277,129, filed Sep. 21, 2009, entitled "Robotic Boxing Trainer (RBT)" by the same inventor.

BACKGROUND OF THE INVENTION

A. Field of the Invention:

The present invention relates generally to sports and fitness training systems and more specifically, to a training device for boxing, martial arts, reaction time training, or general recreational use, which physically interacts with a user by absorbing blows while throwing punches and counterpunches.

B. Description of the Prior Art

Boxing, kickboxing and martial art sports, referred to herein collectively as "boxing" sports, require a high degree of physical training. Reaction time is of paramount importance, particularly in boxing. As a result, the participants in these sports require a means of maintaining and improving the associated physical skills. In the past, boxers generally attempted to improve their hand-eye coordination and reaction time skills by punching passive devices such as heavyweight bags, speed bags or other types of basically passive targets. Alternatively, these participants have sparred against another fighter to hone their punching and kicking skills. Certain devices have attempted to produce a degree of physical interaction between the user and the devices with some degree of animation, but these devices have not been widely adopted and have not been generally successful in the marketplace.

Two exemplary prior art devices used in the past are the speed bag and double-end bag. The double-end bag is perhaps the only device currently on the market which requires some degree of blocking, dodging, ducking, deflecting, etc, as the bag is struck and then comes back at the user. This sort of simulated action can also be achieved, to some limited degree, with a speed bag by the user hitting the bag and, as it bounces back and forth, dodging the bag before it is hit again. Even with these capabilities, the speed bag and double-end bag fall far short of simulating the actual experience of boxing.

Thus, each of the two primary prior art training techniques, the passive bag or the use of a sparring partner, has its deficiencies. The passive devices only receive blows and offer little active resistance to the fighter. Sparring with another individual can cause injury to the participants of the sport. Medical research has shown that boxing and contact martial arts can cause various medical problems including such things as concussions, brain damage, injury to various parts of the head such as the mouth, eye and ear. Even an individual holding a pad while the participant strikes the pad may also be subject to injury.

The prior art training devices, for the most part, fail to provide a real-life sparring opportunity because they only accept punches without delivering punches or counterpunching. Thus, these devices are inadequate in preparing a boxer for a competitive match. A boxer must utilize the services of a sparring partner in order to properly prepare for competitive matches or bouts. They may also be ineffective in helping to improve the reaction time of a boxer, because of the inherently passive and somewhat clumsy nature of the devices.

Thus, there remains a need for a universal training apparatus which does not posses the disadvantages associated with the training devices of the prior art.

There exists a need, therefore, for a physical training interaction device in which physical movement of the device resembles the real life movement of a potential opponent, such as the punch delivered by a boxing opponent.

A need also exists for a device which will aid and/or develop timing and/or reaction skills of a participant using the training device.

In addition, a need exists for such a device which will train and/or improve hand and eye coordination, as well as promoting the general physical condition of a user, such as by providing a cardiovascular workout.

A further need exists for a device having the inherent physical characteristics which upon impact or engagement with the user provide a realistic feel of the timing skills needed in boxing or hand-to-hand combat.

A still further need exists for such a training device which may be adjusted for various physical attributes of the user or desired type of training and which allows for specific programmability of the training device.

There exists a need for such a device which is relatively simple in design and economical to manufacture.

SUMMARY OF THE INVENTION

The interactive boxing training device of the invention includes an inner tube and an outer tube received over the inner tube in telescoping fashion. A fluid propulsion system is provided for propelling the outer tube outwardly along a generally horizontal axis in a stroke defined between a retracted position and an extended position, upon demand. The training device also includes a retraction system to return the outer tube to the retracted position after each stroke.

Preferably, the fluid propulsion system is a source of compressed air and an air delivery system. The inner tube can be mounted in a housing at a pivot or articulation point which allows 360 degrees of freedom of movement of the outer tube in addition to the movement of the outer tube along the horizontal axis which defines its stroke. The housing can itself be mounted on an upright rail which allows the housing to have a vertically adjustable height. The outer tube is preferably shaped as an elongate cylinder, the cylinder having a flexible foam cover. A boxing glove can be mounted on an outer extent of the outer tube, if desired. The retraction system can comprise one or more elastomeric elements which are stretched as the outer tube moves to the extended position and which are relaxed as the outer tube moves back to the retracted position.

Where a housing is present to contain certain of the component parts of the training device, the housing can itself be removable from the upright rail so that the device can be pointed at a boxing trainee in order to simulate punches thrown at the boxing trainee. Also, the inner tube, outer tube and retraction system can be provided as an assembly in the form of an elongated stick. The elongated stick can itself be provided with a piston grip and a trigger for actuating the fluid propulsion system.

In one preferred form of the invention, the outer tube punches will have at least 8000% less force than a human punch going at the same speeds due to the outer tube weighing much less than a human arm and it not building the kinetic energy of a human body behind the punch. This percentage difference is across the spectrum of speeds. At the same time, the outer tube is capable of reaching speeds on the order of up to 17 mph when supplied with, e.g., 125 psi of fluid pressure. In its most preferred form, the outer tube weighs less than about 10 ounces.

In one preferred form of the device and assembly of the invention, the fluid propulsion system which is used for propelling the outer tube outwardly along a generally horizontal axis comprises a source of compressed air and at least one air supply tube for supplying a burst of compressed air to an interior region between the inner and outer tubes for propelling the outer tube to the extended position. The fluid propulsion system further comprises an electronic controller and at least one associated solenoid valve, the controller being operable to send a DC voltage to the solenoid valve at selected intervals determined by a user to control the supply of air in the fluid propulsion system. The electronic controller is programmable to send the DC voltage at an interval selected by the user, which interval can be a random interval, if desired.

In the method of using the interactive boxing training device of the invention, the assembly of component parts is provided as has been described. The outer tube has an outer extent which acts as a punching member for simulating sparring with a boxing opponent. The inner and outer tubes and associated fluid propulsion system can be mounted at a fixed station location. Alternatively, the inner and outer tubes and associated fluid propulsion system can be contained in a mobile component arrangement which allows a trainer to hold the components and move the components about while sparring with a trainee.

Additional objects, features and advantages will be apparent in the written description which follows.

DETAILED DESCRIPTION OF THE INVENTION

Figure 1:
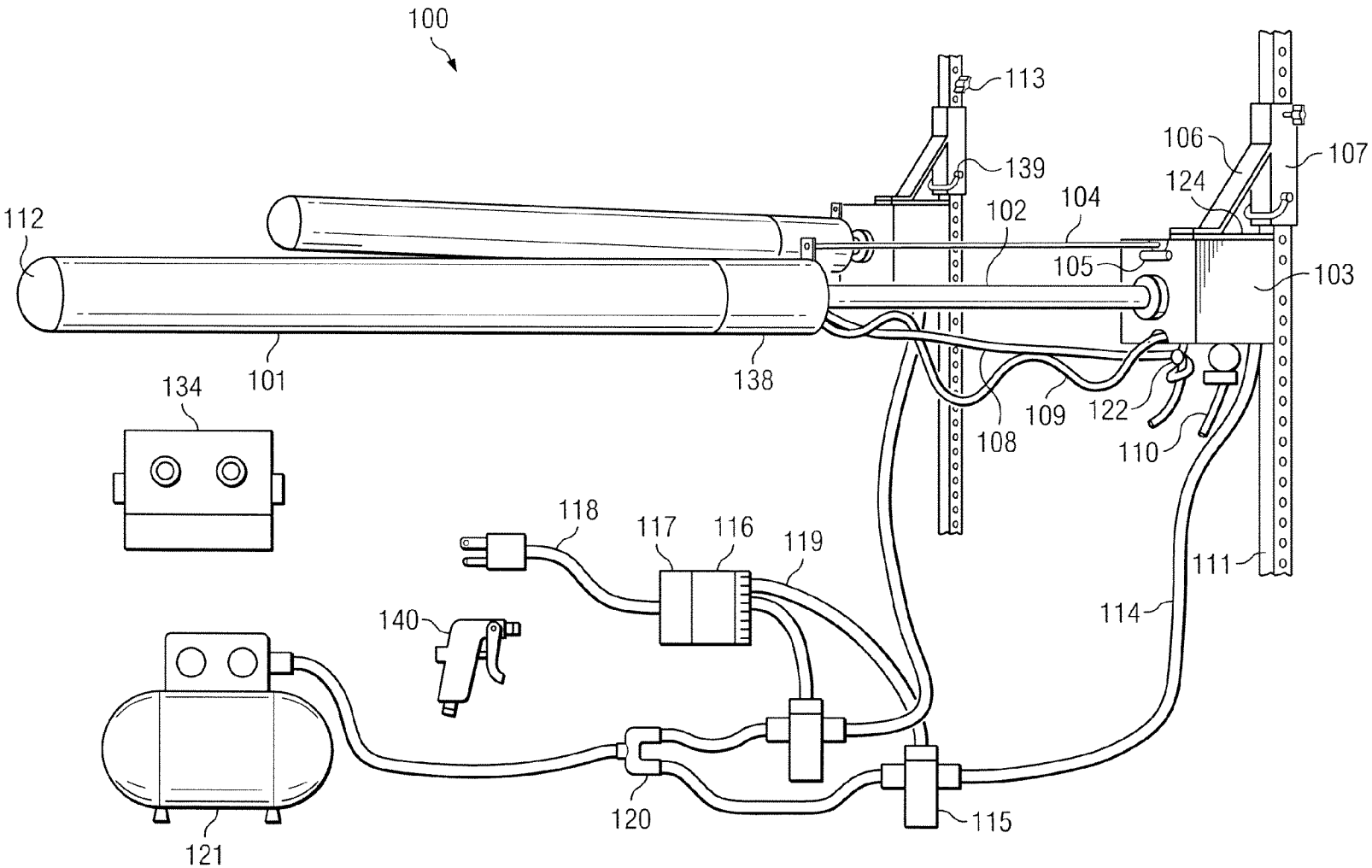
FIG. 1 is a perspective view of the device of the invention, showing a complete assembly of the invention with a pair of punching arms being utilized and with the controller portion and optional air gun of the device shown in isolated fashion for ease of illustration.

The preferred version of the invention presented in the following written description and the various features and advantageous details thereof are explained more fully with reference to the non-limiting examples included in the accompanying drawings and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

General Attributes of the Device and System of the Invention:

The device of the invention meets the various deficiencies noted with respect to the prior art by providing more than a simple training and fitness accessory. It also fulfills a safety need. It is necessary that the device, first and foremost, be light and strong. This is a difficult task to accomplish in that the device, by its very nature, is subject to a variety of different kinds of abuse from not only boxing at the speeds it does (whether it does not hit or hits), but also from the user from sudden side deflections or possible direct hits on the outer tube (101) assembly when it is or is not in the home position. If the punching arms are not strong enough, they will bend. If the "shoulder" of the device is too stiff, it is unrealistic to mimic a human arm deflection, puts too much strain between the outer tube (101) and the inner tube (102) when fully extended and deflected, and also puts too much strain into the shoulder assembly of the device and user. If the shoulder is too weak it can not hold the punching arm as it extends fully.

There are numerous medical studies proving that full contact boxing and martial arts does short term and long term damage to the brain even when full head gear is worn. It simply isn't possible to have the mass behind a human arm moving at a high speed and have it hit someone's head area without doing some degree of damage to the brain. The punching arms of the training device of the invention are very light by nature and thus can move at human punch speeds but with much less force. These qualities of the device of the invention allow a user to train under realistic punch speeds in order to improve reaction time, agility, and associated skills, and yet not suffer the abuse of human punches at the same speed.

The training device of the invention also helps the user to get over the intimidation factor of punches coming toward a person. Over time, the user learns to be relaxed both when throwing and when receiving punches so that the user's muscles react more quickly. The user of the device learns to stay focused on what counts and to block out what does not count. Focusing on what counts, by its nature, increases reaction time. The training device of the invention has no muscles, facial expressions or any other human trait which can be detected before it throws a punch, unlike humans who can twitch, squint, move a fist back just slightly before the punch it, or have other telegraphing signs before a punch is thrown.

The training device of the invention provides unique assistance to users in the field of boxing and martial arts training by giving the user a true sense of a boxing opponent, and beyond that, it teaches at various levels of force or intensity, so that a user's progression can be tied to the user's own ability. The device is not strictly limited to boxing and martial arts training. Due to the fact that it is so much fun to use, fitness enthusiasts would enjoy the workout it gives. Military, security and law enforcement will not only find it helpful as a means of staying in fighting form, put also as a training aid by attaching a light, fake knife, or the like, to the front of the arm(s) to practice blocks, dodges, etc. Since the device of the invention has arms which truly mimic the forward and retraction speeds of a human arm, true reality of the techniques used in defense are realized.

In the discussion which follows, the term "boxing" training device is utilized for simplicity but it will be understood from the foregoing discussion that any of the enumerated sports or activities are intended to be encompassed by the term.

Requirements for Achieving the Designed Attributes of the Invention:

In order to achieve these goals and advantages, it is necessary that the device of the invention possess the following characteristics to achieve the desired attributes of the invention:

Be light and yet very strong.

Be able to deliver a fast punch and also exhibit a fast return anywhere along the punch path. If the punch is blocked or makes a hit during its travel, it has to be capable of a fast return. If the arm fully extends at any speed, it has to make a fast return.

Be able to deliver a fast punch and yet not generate high forces to the person of the boxer/user. All that is required is that head and body protection gear be worn and the felt force is very low. If the punches are only adjusted to head height, then only head gear is required. The same is true of the body.

Be able to punch and yet not hurt the boxer/user's fist anywhere in the punch arm's path in the event they meet, whether the punch arms are punching, retracting or in the fully retracted position.

Be able to move or be articulated in a range of motion generally 360 degrees perpendicular to the boxer's facing position to replicate arm deflection. The deflection strength must be strong enough to hold the arm as it adds inch pounds as it extends and yet be weak enough not to add strain to the boxer deflecting the punch arm.

After defecting, the punch arm must return quickly back to its punch path and not wobble side/side or up/down for an extending period of time.

Be adjustable in height, width, punch length, punch speed and number of punches thrown.

The punch arm must be padded on the front so the boxer's bare fist could not get hurt even when the punch arm is fully retracted in its stationary, firm position.

The punch arm must be fully padded on the sides to pad deflection blows from the boxer.

The foam or other padding material must be surrounded in a durable, light weight cover.

The device must be capable of truly random punch sequences in order to keep the boxer always guessing when the next punch is coming and as to which aim will be punching.

Both punch arms cannot fully punch at the same time.

Either arm should be removable from its respective rail and be held by a boxing trainer so that it can be pointed at a boxing trainee as the trainer points the arm at will in any area of the trainee so as to simulate punches to the trainee. This will give the trainee a chance to practice dealing with high speed punches without the detriment of injury a human punch would give traveling at the same speed. The trainer could use the random mode punches or easily attach a push button manual mode so the trainer can determine when the punch arm will punch.

Be reasonable in price so as to appeal to the general public involved with such a sport.

Be durable and not so complex as to have a high repair rate.

Offer various modes of operation to either arm independently. This is helpful if a user wishes to only turn on one arm and not box but simply practice blocking. Or a user may want to have more punches thrown from one arm and not the other.

Allow the user to use the device of the invention in conjunction with any number of prior art devices, such as a double-end bag, heavy bag, free standing heavy bag, boxing dummy, etc. Since the entire arm setup is adjustable, all could be accommodated, as long as the user takes into account the fact that the wider the punching device, the more the arms have to angle to reach the user which could make the arms only punch at an angle.

In the case of the user incorporating a prior art punching device, it is up to the user's comfort level as to where to place the secondary device in relationship between the arms of the training device of the invention. For realism, it is best to place the device so that an outstretched jab from the user touching their punching device allows the training device arms to reach them also, so that if you are in the range to be the hitter, you are also in the range to be the "hittee".

Be able to throw very fast punches that achieve speeds which give the boxer/user much less than a tenth of a second to react, and yet also throw slower punches at lower settings to give reaction times more realistic to the average user.

Be fun to use.

Component Description:

The component parts and operation of the apparatus and system of the invention will now be described with respect to FIGS. 1-4B of the drawings. Turning first to FIG. 1, the interactive device of the invention includes a controller (134) and one or more arms such as first and second arms (100). The arms consist of an outer tube (101) which is typically surrounded by a padded foam cover. The outer tube (101) is supported by an inner tube (102). The inner tube (102) is supported in a housing, such as metal box (103), such that a compressed spring (129 in FIG. 2) held in tension by tube clamps (128) puts a force on the inner tube (102) to support it in an erect, horizontal position by sandwiching the metal box cover (136) against the compressed spring (129) and then using cover screws (122) to screw that assembly onto the front of the metal box. (103).

In order to offer further support to the outer tube (101) as it punches forward away from the metal box (103) more inch pounds of weight can be added to the inner tube (102) by means of a rear bungee cord (110) that has adjustable tension from outside the metal box (103) such that the bungee cord wraps around the end off the inner tube (102). The compressed spring (129) along with the rear bungee cord (110), that is adjusted in tension by a cord stopper (135), act as a "shoulder" to the complete arm assembly. This "shoulder" arrangement allows the arm assembly, comprised of the outer tube (101) and inner tube (102) which extend outwardly from the front of the metal box (103) allow the punching arm to move or be articulated about a pivot point in a range of motion generally 360 degrees perpendicular to the front of the boxer/user. This arrangement allows the arms to be deflected in any direction, just as a boxer would deflect a human punch off its intended path. This same assembly also acts to stabilize quickly to centerline and not wobble back and forth from centerline for an undue amount of time.

The controller (134) contains a power supply (117 in FIG. 1), a programmable logic controller (116), pneumatic solenoid valves (115), and an air hosing (114). The air hosing is used to connect the arm assembly to a fluid propulsion system for propelling the outer tube outwardly along a generally horizontal axis in a stroke defined between a retracted position and an extended position, upon demand. In the example shown in FIGS. 1 and 2, a T-valve (120) connects the main air supply hose coming from the user's own air compressor (121) that will T off to the air hoses (114) then to the pneumatic solenoid valves (115), then to the air connector inner tube end (132). The power supply (117) has a power cord (118) that plugs into an electrical outlet.

With compressed air going into the controller (134) from an air compressor (121), the programmable logic controller (116), will send a DC voltage to either of the pneumatic solenoid valves (115) at selected intervals chosen by the user on the controller's knobs and/or switches. The solenoid valve wiring (119) gives the voltage to open the valve in the pneumatic solenoid valves (115) for a selected period of time so that it sends that burst of air up the tube (114) to the air connector inner tube end (132). This air travels through the inner tube (102) and finds the path of least resistance and is forced to push the outer tube (101) forward because the outer tube (101) and inner tube (102) have a tight tolerance and leaves very little air to escape. The amount of speed the outer tube (101) travels forward is controlled by the air compressor's (121) psi setting. The higher the psi, the faster the outer tube (101) will move forward.

The device of the invention also includes a retraction system to return the outer tube to the retracted position, upon demand, The retraction system can comprise one or more elastomeric elements which are stretched as the outer tube moves to the extended position and which are relaxed as the outer tube moves back to the retracted position. Because of the various jab speeds, a front bungee cord (108) is attached to the outer tube's (101) end and goes through an eyelet (131) at the bottom of the metal box (103) such that the front bungee cord (108) can be adjusted in length by a cord stopper (135). As a result, the very end of the outer tube's (101) forward travel is cushioned by the front bungee cord (108). The front bungee cord (108) will stretch until the rope (109) is pulled fully taut giving the outer tube (101) a hard stop. Along the front bungee cord's (108) path from the outer tube (101) to the eyelet (131), at several points it is attached to the rope (109) in such a way to prevent tangling and yet still allows the front bungee cord (108) to stretch naturally. The higher the psi setting, the more front bungee cord (108) stretch is required for the smoothest operation and natural punch action. Even without the front bungee cord (108), the retraction cord (104) will retract the outer tube (101) but not as swiftly if used in combination with the front bungee cord (108). The rope (109) is attached to the end of the outer tube (101) and into the metal box (103).

The outer tube (101) retraction is accomplished by the circumstances, such that if the outer tube (101) is allowed to fully extend, the front bungee cord (108) extension will pull back to its normal relaxed status thereby pulling back the outer tube (101) at least to that point, as the retractor cord (104) pulls the outer tube (101) all the way back to the home position fully retracted ready for the next burst of air. If the outer tube (101) is blocked or makes a hit before the front bungee cord (108) stretches, then the retractor cord (104) will pull back the outer tube (101) to the full home position fully retracted. The retraction is cushioned by a rubber washer (127). To prevent the outer tube (101) from wearing into the rubber washer (127), a hard plastic end cap (126) is installed. The retractor cord (104) has a hard plastic tube (105) attached to the metal box cover (136) just below the retractor cord (104) so that if the outer tube (101) is spun clockwise or counter clockwise, the hard plastic tube (105) will protect the retractor cord (104) from the surrounding metal on the metal box cover (136).

The outer tube (101) when fully extended all the way to its hard stop by the rope (109) pulled taut leaves minimum outer tube (101) and inner tube (102) connection that puts leverage between the rubbing surfaces. To leave friction between those surfaces to a minimum, a thru-notch was put at the top of the inner tube (101) so that a plastic hard tube (105 in FIGS. 2 and 3) breaks through the inner diameter of the outer tube (101) and touches the top surface of the inner tube (102). The correct tension against the hard plastic tube (105) against the top of the inner tube (102) is accomplished by an extension spring (123) going through the hard plastic tube (105) and being tensioned around the circumference of the inner tube (101) by a tie wrap (137). That assembly is protected by a rear cover (138).

The metal box (103) is supported by a 45 degree bracket (106) and L-bracket (124) that both attach to the outer rail (106). The outer rail (106) can be adjusted in height along the inner rail (111) and locked in by a lock pin (139). At the top of the outer rail (106) on both sides are a total of four swing adjustment screws (113) such that they can adjust where the arms point due to the remaining slop between the outer rail (139) and the inner rail (111). The inner rails (111) can be adjusted in width such as the user desires. At the front of the outer tube (101) is a flexible cushion (112).

An air gun (140 in FIG. 1) can be supplied so that the user can activate either arm by disconnecting the air hose (114) from either side of the controller (134) and connecting them to the air gun (140) to allow manual operation of the air burst. This is particularly helpful if a trainer wants to take off an arm assembly and hold it as the trainer points the arm at the trainee and manually throwing punches with the air gun (140) or not using it and letting the arm point at the trainee as the arm continues to punch at random. It will be apparent that by removing the arm assembly, the device can thus be utilized as a stand alone device which can be pointed at a boxing trainee in order to simulate punches thrown at the trainee. For example, the inner tube, outer tube and retraction system can be provided basically in the form of an elongated stick. The elongated stick can be provided with a pistol grip and trigger for actuating the fluid propulsion system.

The controller (134) has the option of only turning on one arm or two or more arms on. It has the option of also setting one arm to ON mode and the other arm or arms in their own separate mode. In the rare event both punching arms fire at roughly the same time, the T-valve (120) will only give both pneumatic solenoid valves (115) half their air supply and not allow the outer tubes (101) to move fully forward.

The operation of the device will now be described with respect to FIGS. 1-4. Turning first to FIG. 1, the controller (134) is shown by itself with control knobs for both arms but more knobs and switches could be added if needed. Inside the controller (134) are the following components: power supply (117), programmable logic controller (116), pneumatic solenoid valves (115) and their wiring (119), T-valve (120) and needed air hoses (114) and their connections. Coming out of the controller (134) is a power supply plug (118) and air the hoses (114). Coming into the controller (134) is an air hose (114) coming from the user's air compressor (121). After several seconds of a punching arm or arms being turned on, the programmable logic controller (116) will send a DC signal to the pneumatic solenoid valves or valves (115) which will in turn allow a timed release of compressed air up the air hose (114) to the rear of the inner tube (102), which will in turn push the outer tube (101) forward. If the outer tube (101) is blocked before extending fully, the retractor cord (104) will suddenly pull it back to the home position. If the outer arm (101) does fully extend, then the front bungee cord (108) will stretch and the rope (109) will extend fully and stop the outer arm (101) from any more forward travel. At that point the front bungee cord (108) and the retractor cord (104) will quickly bring the outer arm (101) to the home position.

Figure 2:
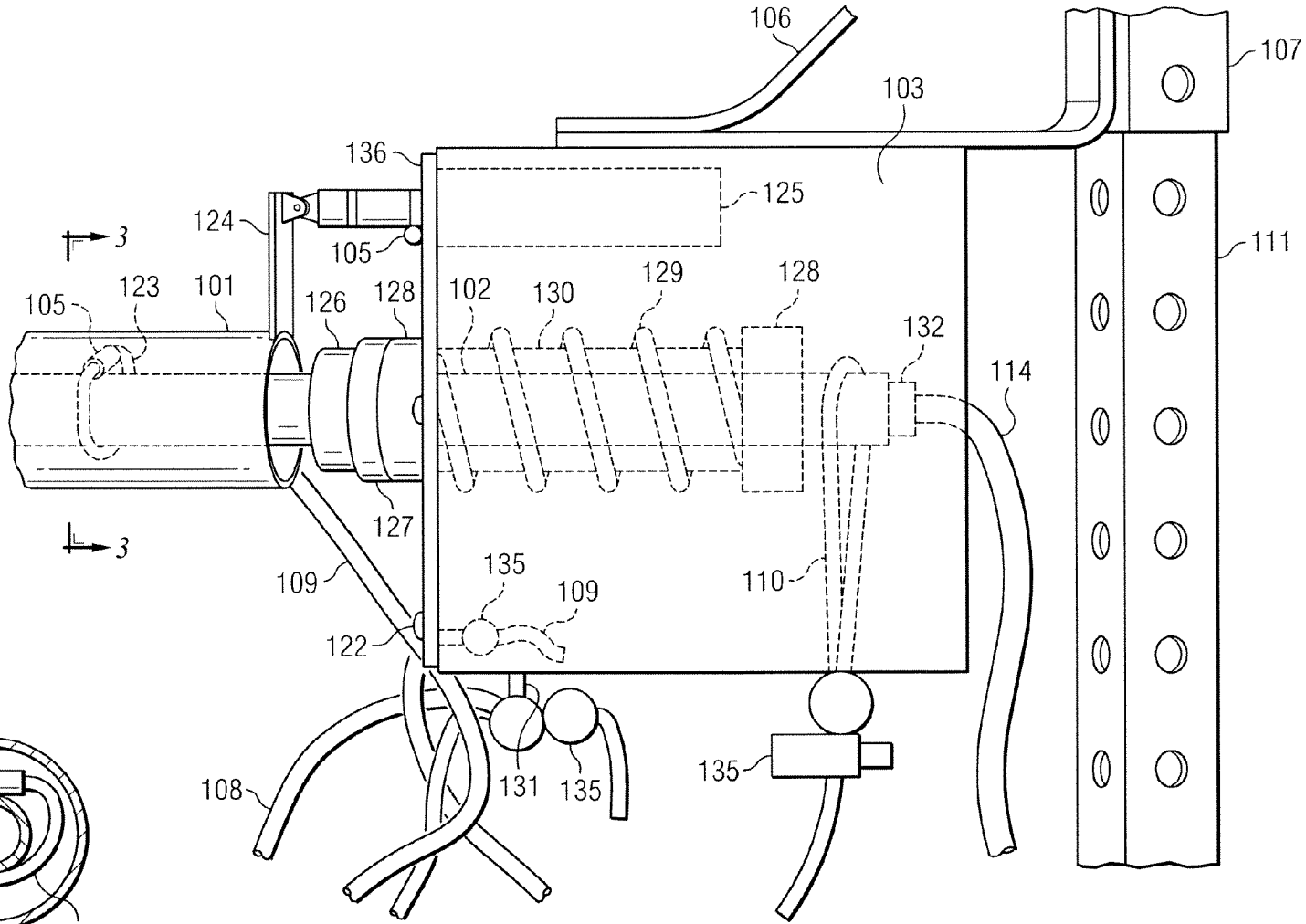
FIG. 2 is a close up, side view of a portion of the assembly of FIG. 1 showing the internal details of the metal housing associated with each of the punching arms of the device and illustrating the inner and outer tubes which make up the punching arms of the invention.

FIG. 2 shows the inner components of the metal box (103) and the inner working between the outer tube (101) and the inner tube (102). Inside the metal box (103) is a compressed spring (129) held sandwiched between two tube clamps (128). Also sandwiched between the tube clamps (128) is the metal box cover (136). That spring force against the metal box cover (136), along with the rear bungee cord (110) that wraps around the inner tube (102) give the punching arm the needed stability to keep it horizontal as the outer tube (101) extends and yet leave enough play if the punching arm was deflected in any direction. The rear bungee cord (110) can be tensioned as desired by using a cord stopper (135). A small tool retractor (125) is secured to the inner top of the metal box (103). The outer tube (101) and the inner tube (102) are also provided with a friction reducer by cutting a thru-notch into the top of the outer tube (101) large enough for a hard plastic tube (105) to protrude into the path of the top off the inner tube (102) so part of the upper tube's (101) weight is resting on the hard plastic tube (105). Exactly how much weight is rested on the hard plastic tube (105) is determined by how much force the extension spring (123) is tensioned by a tie wrap The end of the outer tube (101) is a hard plastic end cap (126) that bumps into the rubber washer (127) when the outer arm (101) retracts.

Figure 3:
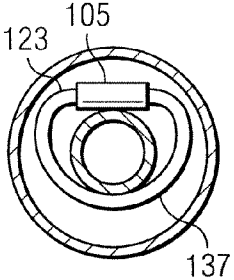
FIG. 3 is a front, sectional view, taken along lines in FIG. 2, showing the hard plastic tube and the thru-notch associated with the outer tube of the device.

FIG. 3 is a front view of the thru-notch with the hard plastic tube (105) in the notch and the extension spring (123) going through hard plastic tube (105) as the extension spring (123) is pulled taut as desired by the tie wrap (137) going around the circumference of the outer tube (101).

Figure 4A:
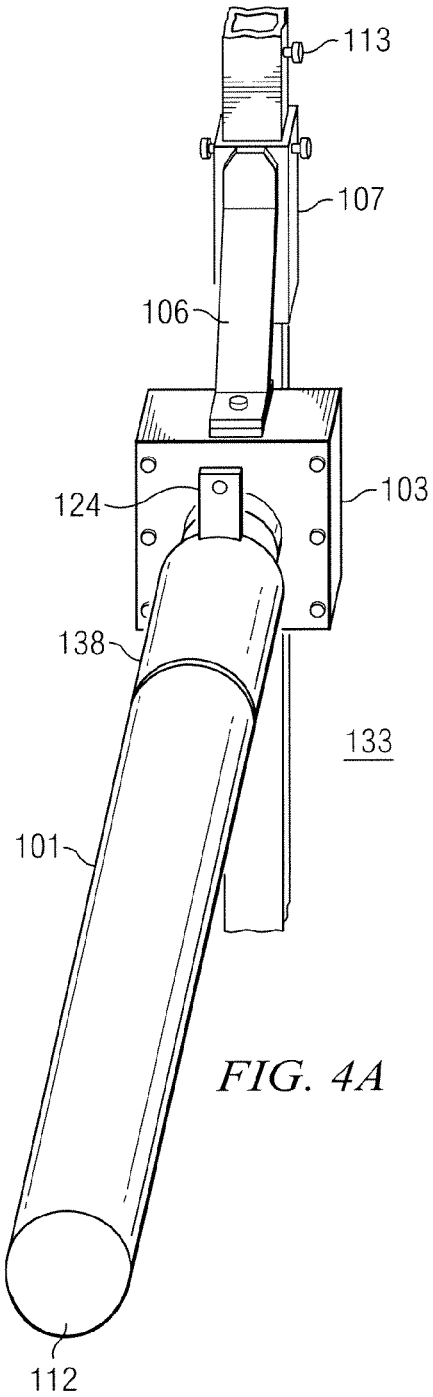
FIGS. 4A and 4 B are front views of the two punching arms which make up a part of the assembly of the invention.
Figure 4B:
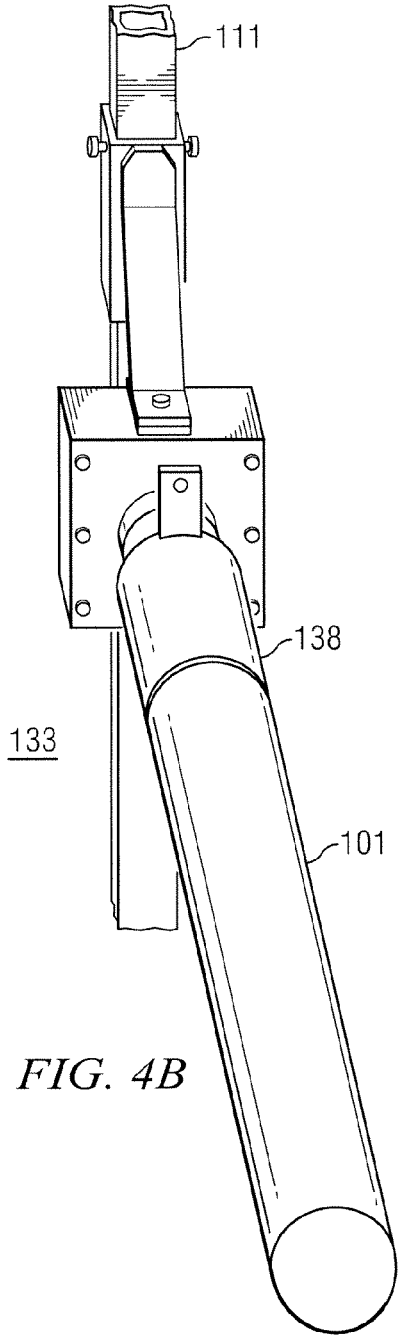

FIGS. 4 A and 4B are front views of the punching arm assemblies where two arms are utilized. The front of the outer tube (101) has a flexible cushion (112) to soften the punch as it reaches an object. The outer tube (101) front, just behind the flexible cushion (112) is also surrounded by foam that has a flexible, synthetic cover surrounding the foam. Behind the foam on the outer tube (101) is a rear cover (138) that encloses and protects the thru-notch design consisting of the hard plastic tube (105), tie wrap (137) and its extension spring (123) on the outer arm (101). Area (133) is the location for the user's chosen hitting device. Also shown is the outer tube's L bracket (124), metal box (103), 45 degree bracket (106), outer rail (107), swing adjustment screws (113) and inner rail (111). The rails may also be bearing rails that allow the punching arms to move up and down rather than remaining stationary.

Summary of the Principal Components of the Device of the Invention:

1. An arm made up of an outer tube (101) that is protected by covered foam surrounding it and a flexible cushion (112) in front of it, a cover surrounding the rear portion such that it protects the thru-notch mechanism (105), (123), (137) to reduce friction from the inner tube (102). The front end of the outer tube (101) is capped by a plastic plug. At the end of the outer tube (101), the top has a secured L-bracket (124) that attaches to the retraction cord (104). The bottom end of the outer tube (101) is attached to the front bungee cord (108) and rope (109). At the very end of the outer tube (101) is a hard plastic end cap (126) that prevents the end of the outer tube (101) from digging into the rubber washer (127). The flexible cushion (112) can also be a boxing style glove or other attachment.
2. An inner tube (102) rides inside the outer tube (101). At the end of the inner tube (102) in order are: a rubber washer (127), a tube clamp (128), a metal box cover (136), a compressed spring (129), a spring filler (130), another tube clamp (128), a rear bungee cord (110), an air connector to inner tube end (132) and an air hose (114). That assembly comprises of the shoulder inside the metal box (103). The shoulder allows the outer tube (101) and the inner tube (102) to deflect up/down/side/side in all 360 degrees during full retraction or full extension. The rear bungee cord (110) is adjustable in tension by a cord stopper (135). Between the tube clamps (128) washers may be used.
3. A retraction system made up of a retraction cord (104) that attaches to an L-bracket (124) that is attached to the end of the outer tube (101). The other end of the retraction cord (104) connects to the retractor (125) fastened inside the metal box (103) at the top. Attached to the front of the metal box cover (136) just below the retraction cord (104) is a hard plastic tube (105) that protects the retraction cord (104) from abrasion from the metal box cover (136) thru-hole if the outer tube (101) is spun clockwise or counter-clockwise during deflection. A front bungee cord (108) that attaches to the bottom of the outer tube (101) and then goes through an eyelet (131) at the bottom of the outside of the metal box (103). Along the front bungee cord's (108) path from the outer tube (101) to the eyelet (131), at several points it is attached to the rope (109) in such at way to prevent tangling and yet still allows the front bungee cord (108) to stretch naturally. The front bungee cord (108) is adjustable in length by the use of a cord stopper (135). Since various speeds can apply to the outer arm's (101) punch, the front bungee cord (108) can be adjusted by the cord stopper (135) for the best retraction speed.

Also attached to the bottom end of the outer arm (101) is a rope (109). The other end of the rope goes through the front cover (136) thru-hole and is captured inside of the metal box (103). The rope (109) creates a hard stop when the outer tube (101) propels forward. The metal box cover (136) is attached to the metal box (103) by cover screws (122). The rope (109) and front bungee cord (108) are connected together at several points along their length as to prevent any tangling. The connections are such that they don't interfere with the rope's (109) and front bungee cord's (108) operation.

4. A timed fluid propulsion system to propel the outer tube (101) and any other outer tubes (101) at random times to mimic punch intervals. The propulsion system could be pneumatic or conceivably even hydraulic. Preferably, the propulsion source is from the user's air compressor (121). The air compressor hose will connect to the controller (134). That connection will be to the bottom of the T-valve (120) that will branch off to pneumatic solenoid valves (115) via air hoses (114). The number of T-valves (120), pneumatic solenoid valves (115) and air hoses (113) can vary in number. At the other end of the pneumatic solenoid valve (115) is more air hose that will lead to the controller (134) air outlet that connects air hose (114) to the back of the inner arm (102) via the air connector to inner tube end (132). The pneumatic solenoid valves (115) have solenoid valve wiring (119) that lead to the programmable logic controller (116) that is also inside the controller (134).

Attached to the side of the programmable logic controller (116) is a power supply (117). The power supply has a power supply plug (118) that will lead outside the controller (134) into a power outlet. The controller (134) will have a various number of knobs and switches on the outside that will leave it up to the customer which arms will be turned on and at what interval speeds per each arm. With compressed air supplied by the customer's air compressor (121), and an arm or arms turned on by the controller (134) controls, the programmable logic controller (116) will follow its set program to send selected impulses of voltage via the solenoid valve wiring (119) for a set time to the appropriate pneumatic solenoid valve (115) which in turn will allow that set psi of compressed air through the pneumatic solenoid valve (115) to the air hose (114) that leads to the back of the inner tube (102). That burst of compressed air will then run down the inner diameter of the inner tube (101) and hit the front end of the capped outer tube (101) and thus propel the outer tube (101) forward until it reaches its max available length or the length it is blocked at. If the psi on the air compressor (121) is set too low, the outer tube (101) will slightly propel or not propel at all.

5. An air gun (140) has the option of being supplied to allow an arm to come off its rail, and be held freely if a trainer wanted to point the arm at the trainee and manually propel the arm via the air gun (140). All that would be needed is to take the air compressor (121) air hose (114), connect it to the back of the air gun (140), take the air hose leading from the back of the inner tube (102) and place it to the open connection on the air gun (140) as such would allow manual activation of the arm punches now. The controller (134) may also include new electronics that add to the existing components or reduce cost of the existing components.
6. An arm connection by a bracket that attaches to the metal box (105) so that the complete arm assembly can be positioned at various heights, widths and angles by either a stationary rail as depicted with an outer rail (107) and inner rail (111) so that the atm assembly can be locked in place via a lock pin (139). The rails can also consist of moveable bearing rails such that allow the arms to also move up and down on their own or by other means of forced movement. If an outer rail (107) and inner rail (111) setup is desired, then the slop between the two can allow for precise angle adjustment by four swing adjustment screws (113) in each of the outer rail (107) sides. The bracket attaching the metal box (103) to the stationary or moving rail can be attached such that it allows no swing movement adjustment for the arm angle at that connection or does allow swing movement adjustment for the arms.

ADVANTAGES OF THE INVENTION

The training device of the invention can be used to improve an athlete/user's reaction time. As one study noted, "Although there are inherent limitations to reaction time, each athlete can improve-shorten-response time and offset some of the limitations that still exist through experience and anticipation." Although reaction time is typically measured in hundredths of seconds, at the elite level, hundredths of seconds can mean the difference between winning and losing, frame and relative obscurity.

The fluid propulsion system, in cooperation with the components of the device of the invention allow the outer tube to be propelled at speeds on the order of 17 mph, if desired. From doing a frame by frame film examination, it takes a reaction time of about 0.070 seconds to stop.

In the case of the improved training device of the invention, the arms are stiff and do not flex. The flex comes from the shoulder which is defined generally as being the assembly of the metal box of housing. The arms mimic the deflection feel of a true straight arm being punched. When a human arm punches straight at a person and it is deflected, it's not the arm that bends (unless it was broken), but rather the shoulder that gives and moves with the arm.

The punching shoulder assembly of the invention is very compact and yet is easy to deflect and yet strong enough to support the arm in its home position and extended position. It gives 360 degrees of deflection movement. It comes back to centerline quickly after the deflection with undue wobble. It uses pneumatic propulsion by just using the right combination of tubes to form the arm. It saves on the cost of manufacturing and saves on buying expensive ready made pneumatic cylinders that would not work nearly as well as the combination of tubing used by the present invention.

The design of the invention takes into consideration the importance of a fast punch ALONG WITH a fast retraction in the various scenarios a punch arm is subjected to. It's one thing to make an arm that punches, but to make that same arm quickly retract given the many parameters of the arm, such as: may be stopped anywhere along its path, the arm may be held for an uncertain amount of time after it extended, the arm may have to retract coming from a deflected position, the arm may have to propel forward again even before it is in the home position, the arm may spin clockwise or counter clockwise from an arm deflection and not disrupt the retraction setup, the arm must not only propel the weight of the arm forward, it must be able to withstand all restraints of the ever-ready retraction cord.

The punch speed chosen is very repeatable and consistent. This is important to let a person see what blocking techniques work best. If the speeds were inconsistent, it is harder to judge that. A person can then see if those same blocking techniques work at the higher consistent speeds.

The retraction system must not be taxed to 100% of their available travel. It must travel along with the arm but not stretch fully to its manufacturer's full limit. In doing so it shortens the life of the retraction system. The retraction setup of the invention uses less than 50% of the max retraction capability that gives it a very long life.

The retractor must be an industrial strength to withstand sudden extensions and retractions that it is subject to thousands of times. An arm can be taken off and held by itself and used by a trainer due to its lightness and compactness having all the needed parts in the punching arm. The assembly of the invention is a very low maintenance design, seldom needing fixes or adjustments. It uses relatively few parts to accomplish the needed tasks. The punch speeds of the device are documented and proven to replicate human punch speeds that are slow to at least up to par with pro boxer speeds making it a fun challenge from the novice up to the pros.

The assembly of the invention uses a straight arm punch movement. It has no elbows. Other devices with elbows actually punch in an unnatural way. In reality, a straight arm is more realistic. Plus, no one punches with their arms half-way hanging at their sides and then rotating them at you as some devices do.

Because the punching arms of the invention offer so much adjustment from the setup position, the arms could be coming straight out at you or angled at you. The "fists" can leave a small opening to the customer's boxing device or a large opening.

The punching arm's outer tube assembly that punches forward weighs less than 10 oz. This weight can be compared to the average human arm that weighs 8 to 12 lbs for a male, and 7 to 9 lbs form female, plus, has body weight transfer to add to that power. The punching arm assembly of the invention has no body transfer; all that moves forward is the punch arm. The device of the invention provides lightness together with strength and also the ability to return to the centerline of the punch path quickly when deflected. The unique lightness of the punching arm assembly is what gives it its relatively low impact when traveling at the speeds it can generate from a very short burst of compressed air.

Nothing about the assembly of the invention has arms that look like human aims or hands. It only resembles them in size. This is particularly important if the user is boxing bare fisted or gloved that has no thumb fastener because any punch arm with a simulated glove or human like fist or hand, leaves areas for the user's thumb to catch onto while punching. The device of the invention intentionally has kept the fist and arm area streamlined. This also gives the user a true sense of real fighting. If the device were equipped with boxing gloves or huge fists, what may appear to be good blocking techniques by blocking the boxing glove or large fist, in reality could prove to be poor one.

Because the user can set their own punching device in any desired location, this allows them to place their punching device front surface as near or far from the punching device's fists as desired. For the most realism, it would be best to set the punching device surface such that if the user's extended jab can reach their punching device surface, then the extended punching arm should be able to reach the user. In other words, if the user is close enough to hit their punching device, the punching arm is close enough to hit the user. Still, the user has the choice of changing that distance to more of their reach advantage or to their disadvantage. The device of the invention offers unlimited distance options.

The punching arms of the device of the invention will propel forward even if they have a slight object touching the sides of them. This is important in the case of a user using their own punching device, as discussed above. For example, it is possible to use a double-end bag with the training device of the invention. Because that style bag is on two vertical extension cords top and bottom, it travels in many directions bouncing off the sides of the punching arms of the inventive device, and yet, the punching arms will still propel even if the double-end bag is hitting the sides of them at that moment.

The assembly of the invention can use one or multiple arms, although two arms are most practical and enough challenge in themselves. One arm can be turned on by itself and set to different modes, or, both arms or more can be set to their individual modes. This is especially helpful if the user wants to practice on blocking reflexes using just one arm. The user can stand in front of the arm as the arm randomly punches to not only quicken their reaction time, but also practice their technique in what block works fastest and best. Having both arms on at the same speed or one arm punching more frequent offers customization of use to the user.

Both arms cannot punch fully at the same time. Because both arms share the same main air line, if both arms trigger near the same time, the air supply to each of them is reduced in half. This provides a safety advantage for the device.

While the invention has been shown in only one of its forms, it is not thus limited but is susceptible to various changes and modifications without departing from the spirit thereof.

What is claimed is:

1. An interactive boxing training device, comprising: a stationary support;

an inner tube;

an outer tube received over the inner tube in telescoping fashion; said outer tube is shaped as an elongate cylinder, the cylinder having a flexible foam cover;

a fluid propulsion system for propelling the outer tube outwardly along a generally horizontal axis in a stroke defined between a retracted position and an extended position, upon demand;

a retraction system to return the outer tube to the retracted position after each stroke.

2. The interactive boxing training device of claim 1, wherein the fluid propulsion system is a source of compressed air and an air delivery system.

3. The interactive boxing training device of claim 2, wherein the inner tube is mounted in a housing at a pivot point which allows 360 degrees of freedom of movement.

4. The interactive boxing training device of claim 3, wherein the housing is itself mounted on an upright rail which allows the housing to have a vertically adjustable height.

5. The interactive boxing training device of claim 1, wherein the retraction system comprises one or more elastomeric elements which are stretched as the outer tube moves to the extended position and which are relaxed as the outer tube moves back to the retracted position.

6. The interactive boxing training device of claim 4, wherein the housing is removable from the upright rail so that the device can be pointed at a boxing trainee in order to simulate punches thrown at the boxing trainee.

7. The interactive boxing training device of claim 1, wherein the outer tube and the inner tube are provided with a friction reducer.

8. The interactive boxing training device of claim 1, wherein the outer tube is capable of reaching speeds of up to 17 mph at 125 psi of fluid pressure.

9. The interactive boxing training device of claim 1, wherein the outer tube weighs less than 10 ounces.

10. An interactive boxing training device, comprising:

an inner tube;

an outer tube received over the inner tube in telescoping fashion; said outer tube is shaped as an elongate cylinder, the cylinder having a flexible foam cover;

a fluid propulsion system for propelling the outer tube outwardly along a generally horizontal axis in a stroke defined between a retracted position and an extended position, upon demand, the fluid propulsion system comprising a source of compressed air and at least one air supply tube for supplying a burst of compressed air to an interior region between the inner and outer tubes for propelling the outer tube to the extended position, and wherein the fluid propulsion system further comprises an electronic controller and at least one associated solenoid valve, the controller being operable to send a DC voltage to the solenoid valve at selected intervals determined by a user to control the supply of air in the fluid propulsion system;

a retraction system to return the outer tube to the retracted position after each stroke.

11. The interactive boxing training device of claim 10, wherein the electronic controller is programmable to send the DC voltage at random intervals to operate the fluid propulsion system.

12. A method of training a boxer using an interactive boxing training device, the method comprising the steps of:

providing an assembly comprising an inner tube and an outer tube received over the inner tube in telescoping fashion, the outer tube having an outer extent which acts as a punching member for simulating sparring with a boxing opponent; the outer tube being shaped as an elongate cylinder, the cylinder having a flexible foam cover;

providing a fluid propulsion system for propelling the outer tube outwardly along a generally horizontal axis in a stroke defined between a retracted position and an extended position, upon demand;

providing a retraction system to return the outer tube to the retracted position after each stroke.

13. The method of claim 12, wherein the fluid propulsion system includes a source of compressed air and at least one air supply tube for supplying a burst of compressed air to an interior region between the inner and outer tubes for propelling the outer tube to the extended position, and wherein the fluid propulsion system further comprises an electronic controller and at least one associated solenoid valve, the controller being operable to send a DC voltage to the solenoid valve at selected intervals determined by a user to control the supply of air in the fluid propulsion system.

14. The method of claim 13, wherein the inner and outer tubes and associated fluid propulsion system are mounted at a fixed station location.

15. The method of claim 14, wherein the inner and outer tubes and associated fluid propulsion system are contained in a mobile component arrangement which allows a trainer to hold the components and move the components about while sparring with a trainee.

* * * * *